US008100110B2

(12) United States Patent
Shinogle et al.

(10) Patent No.: US 8,100,110 B2
(45) Date of Patent: Jan. 24, 2012

(54) FUEL INJECTOR WITH SELECTABLE INTENSIFICATION

(75) Inventors: Ronald Dean Shinogle, Peoria, IL (US); Daniel Richard Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 982 days.

(21) Appl. No.: 11/642,743

(22) Filed: Dec. 21, 2006

(65) Prior Publication Data

US 2007/0175448 A1 Aug. 2, 2007

Related U.S. Application Data

(60) Provisional application No. 60/752,408, filed on Dec. 22, 2005.

(51) Int. Cl.
*F02M 63/00* (2006.01)

(52) U.S. Cl. ..... 123/447; 123/294; 123/446

(58) Field of Classification Search ..... 123/446, 123/447, 467, 506, 456, 510–511; 239/533.3, 239/533.9, 88–96
See application file for complete search history.

(56) References Cited

U.S. PATENT DOCUMENTS

| | | | | |
|---|---|---|---|---|
| 4,459,959 | A * | 7/1984 | Terada et al. | 123/446 |
| 4,603,671 | A | 8/1986 | Yoshinaga et al. | |
| 5,413,076 | A | 5/1995 | Koenigswieser et al. | |
| 5,485,957 | A * | 1/1996 | Sturman | 239/88 |
| 5,622,152 | A | 4/1997 | Ishida | |
| 6,360,728 | B1 | 3/2002 | Sturman | |
| 6,453,875 | B1 | 9/2002 | Mahr et al. | |
| 6,491,017 | B1 * | 12/2002 | Mahr et al. | 123/299 |
| 6,513,497 | B1 * | 2/2003 | Mahr et al. | 123/447 |
| 6,644,282 | B2 | 11/2003 | Schwarz | |
| 6,655,355 | B2 | 12/2003 | Kropp et al. | |
| 7,278,398 | B2 * | 10/2007 | Magel | 123/446 |
| 7,316,361 | B2 * | 1/2008 | Magel | 239/89 |
| 2004/0025843 | A1 * | 2/2004 | Magel | 123/446 |
| 2004/0035397 | A1 * | 2/2004 | Magel | 123/447 |
| 2005/0224600 | A1 * | 10/2005 | Brenk et al. | 239/88 |
| 2006/0243252 | A1 * | 11/2006 | Eisenmenger et al. | 123/447 |
| 2006/0243253 | A1 * | 11/2006 | Knight | 123/447 |

FOREIGN PATENT DOCUMENTS

DE 196 29 107 1/1998

OTHER PUBLICATIONS

"Advanced Diesel Common Rail Injection System for Future Emission Legislation", R. Busch, 10th Diesel Emission Reduction Conference, pp. 1-28.

"Heavy Duty Diesel Engines—The Potential of Injection Rate Shaping for Optimizing Emissions and Fuel Consumption", Dr.-Ing. Bernd Mahr et al., Bosch_APCRS.doc, pp. 1-15, vol. 1: Day 1, 2000.

PCT International Search Report, PCT/US2006/049174; International Filing Date: Dec. 22, 2006.

* cited by examiner

*Primary Examiner* — John Kwon
*Assistant Examiner* — Johnny Hoang

(57) ABSTRACT

A system for selectively intensifying fuel for injection utilizing a fuel injector having an intensifier piston connected to a drain and a pressurized fuel source. The intensifier piston includes a control chamber co-axially positioned opposite from an intensification chamber, and a pressurization chamber co-axially positioned between the control chamber and the intensification chamber. The control chamber selectively fluidly communicates with the pressurized fuel source and the drain. The intensification chamber fluidly communicates with the pressurized fuel source and the pressurization chamber fluidly communicates with the pressurized fuel source and a nozzle assembly.

15 Claims, 3 Drawing Sheets

FUEL INJECTOR WITH SELECTABLE INTENSIFICATION

This application claims the benefit of U.S. provisional application No. 60/752,408, filed Dec. 22, 2005, which is incorporated herein by reference.

TECHNICAL FIELD

The present disclosure relates generally to fuel injectors for internal combustion engines, and more particularly to a fuel injector providing variable intensification.

BACKGROUND

Precisely controlling the quantity and timing of the fuel delivered to a combustion chamber of an internal combustion engine may lead to an increase in engine efficiency and/or a reduction in the generation of undesirable emissions. To improve control over the quantity and timing of fuel delivery, a typical fuel injection system, and in particular, a fuel injector, may include an intensifier assembly that pressurizes the fuel for use in the combustion chamber. Intensifier assemblies may be of the dual-fluid type or the single-fluid type.

In a dual-fluid type intensifier assembly, fuel enters a pressurization chamber of the intensifier assembly and a relatively high pressure actuation fluid, such as engine lubricating oil, enters a control chamber of the intensifier assembly. A controllable valve, usually a solenoid type valve, controls the flow of high pressure actuation fluid to the control chamber by opening and closing a high pressure inlet. Activating the solenoid valve opens the high pressure inlet allowing the high pressure activation fluid to act on one end of the intensifier piston. The other end of the intensifier piston is in contact with the fuel in the pressurization chamber. Because the high pressure activation fluid in the control chamber has a higher pressure than the fuel and because the high pressure activation fluid acts on a surface area of the intensifier piston that is larger than the surface area in contact with the fuel, the high pressure activation fluid drives the intensifier piston towards an advanced position. As the intensifier piston moves towards its advanced position, it acts on the fuel in the pressurization chamber, increasing the fuel pressure. When the pressure caused by the intensifier piston reaches a valve opening pressure, a spring biased needle check opens to commence fuel injection into a combustion chamber of the engine. Deactivating the solenoid valve ends the injection cycle and releases pressure in the control chamber of the intensifier assembly. Releasing the pressure in the control chamber drops the fuel pressure in the pressurization chamber causing the needle check, under the influence of its return spring, to close. Closing the needle check ends fuel injection.

Single-fluid type intensifier assemblies do not utilize high pressure engine oil as the actuation fluid. Rather single-fluid intensifier assemblies utilize the same fluid (fuel) for use in both the pressurization chamber and the control chamber. In a single-fluid intensifier assembly, the engine supplies pressurized fuel to the fuel injector from a high pressure supply, such as a high pressure common rail. The fuel injector selectively supplies the pressurized fuel to the control chamber to act on one end of the intensifier piston. Fuel is also supplied to the pressurization chamber of the intensifier assembly. When the fuel is selectively supplied to the control chamber, it acts on the intensifier piston. The intensifier piston then acts on the fuel in the pressurization chamber increasing the pressure of the fuel in the pressurization chamber above the pressure of the fuel supplied to the control chamber. This occurs because the fuel in the control chamber acts on a larger surface area of the intensifier piston than the fuel in the pressurization chamber.

U.S. Pat. No. 6,453,875 ("the '875 patent"), for example, discloses a single-fluid type intensifier assembly for a fuel injector. The '875 patent discloses a fuel injection system including a pressure step-up unit having a pressure chamber in communication with a nozzle chamber via a pressure line and a pressure storage chamber. Control of the pressure step-up unit is effected hydraulically by imposition of pressure from a differential chamber of the pressure step-up unit. The '875 patent however, requires a bypass line parallel to the step-up unit to provide fuel to the nozzle. The addition of the bypass line utilizes valuable space in such tightly confined systems, and adds to the cost and complexity of the system.

The method and apparatus of the present disclosure solves one or more of the problems set forth above.

SUMMARY OF THE INVENTION

In accordance with one exemplary embodiment, a fuel injector includes an intensifier connected to at least one drain and a pressurized fuel source. The intensifier includes a control chamber co-axially positioned opposite from an intensification chamber, and a pressurization chamber co-axially positioned between the control chamber and the intensification chamber. The control chamber selectively fluidly communicates with the drain and the pressurized fuel source, the intensification chamber communicates with the pressurized fuel source, and the pressurization chamber communicates with the pressurized fuel source and a nozzle assembly.

In accordance with another exemplary embodiment, a fuel injector includes an intensifier connected to at least one drain and a pressurized fuel source. The intensifier includes an internal chamber housing an intensifier piston separating the internal chamber into a control chamber, an intensification chamber, and a pressurization chamber. The control chamber selectively fluidly communicates with the pressurized fuel source and the drain, the intensification chamber fluidly communicates with the pressurized fuel source, and the pressurization chamber fluidly communicates with a flow control valve and a nozzle assembly The flow control valve allows continuous supply of fluid to the pressurization chamber.

In yet another exemplary embodiment, a method for selectively intensifying fuel for injection utilizing a fuel injector includes communicating fuel to a control chamber, an intensification chamber and a pressurization chamber of an intensifier piston from a pressurized fuel source. The control chamber selectively fluidly communicates with the drain and the pressurized fuel source, the intensification chamber communicates with the pressurized fuel source, and the pressurization chamber communicates with the pressurized fuel source and a nozzle assembly. The method further includes pressurizing fuel in the pressurization chamber by selectively connecting the control chamber to the drain, and controlling injection by selectively connecting the nozzle assembly to the drain.

DETAILED DESCRIPTION

Reference will now be made in detail to exemplary embodiments of the disclosure, illustrated in the accompanying drawings. Wherever possible, the same reference numbers will be used throughout the drawings to refer to the same or like parts.

Figure 1:
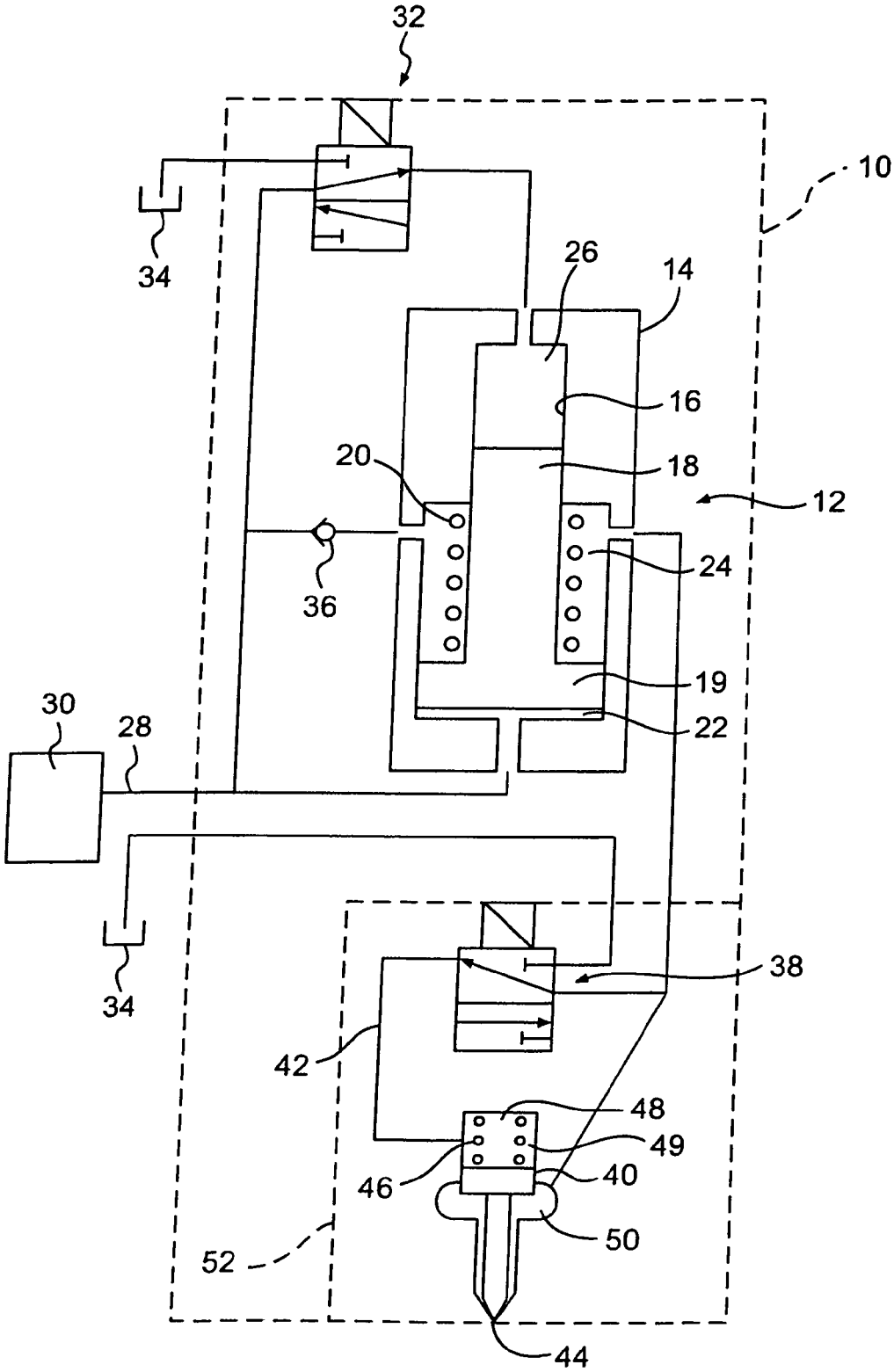
FIG. 1. is a schematic illustration of a fuel injector with an intensifier piston in a starting position in accordance with an exemplary embodiment of the present disclosure.

A fuel injector 10 according to the present disclosure is shown generally in the schematic of FIG. 1. Fuel injector 10 may include an intensifier assembly 12 including a barrel 14, an internal chamber 16 housing a piston 18 and a piston spring 20. Piston 18 may be T-shaped. Alternatively, piston 18 may take on another shape. Internal chamber 16 may be shaped to receive piston 18 such that piston 18 separates internal chamber 16 into an intensification chamber 22, a pressurization chamber 24, and a control chamber 26. This separation of internal chamber 16 by piston 18 allows the surface area of piston 18 in contact with intensification chamber 22 to be greater than the surface area of piston 18 in contact with pressurization chamber 24. It also allows surface area of piston 18 in contact with intensification chamber 22 to be greater than the surface area of piston 18 in contact with control chamber 26. Piston spring 20 may be positioned co-axially within the pressurization chamber 24 for biasing piston 18 towards a first or starting position.

Intensification chamber 22 may be fluidly connected to a fuel line 28. The fuel line 28 may be fluidly connected to a high pressure fuel source 30, such as a high pressure fuel accumulator or common rail. Intensification chamber 22 may be co-axially located on one end of piston 18, opposite from control chamber 26. In the exemplary embodiment, intensification chamber 22 may be positioned between a piston head 19 of piston 18 and internal chamber 16.

Control chamber 26 may be selectively fluidly connected to fuel line 28 or low pressure drain 34 by a first control valve 32. Control chamber 26 may be co-axially positioned at one end of piston 18, opposite from intensification chamber 22. In the exemplary embodiment, control chamber 26 may be positioned opposite from piston head 19, between piston 18 and internal chamber 16.

First control valve 32 may be a solenoid actuated control valve. Solenoid actuated control valves typically control the movement of a valve member from a closed position to an open position using a bias spring and an electromagnetic force created by a solenoid. It should be understood, however, that other types of control valve assemblies, such as piezoelectric valves, may be used with the present disclosure. Accordingly, energization of first control valve 32 allows communication between control chamber 26 and a low pressure drain 34 and prevents communication between fuel line 28 and control chamber 26. De-energization of first control valve 32 allows communication between fuel line 28 and control chamber 26.

Pressurization chamber 24 may be fluidly connected both with fuel line 28 and a nozzle assembly 52. Pressurization chamber 24 may be co-axially positioned between control chamber 26 and intensification chamber 22. In the exemplary embodiment, pressurization chamber 24 may be located between piston head 19 and internal chamber 16.

A one-way valve 36 allows communication from fuel line 28 to pressurization chamber 24 and prevents communication from pressurization chamber 24 to fuel line 28. One-way valve 36 may be a ball check valve or another similar check valve. One-way valve 36 may be operate passively. For example, a ball check valve allows fluid to flow in one direction and passively prevents fluid from flowing in the other direction. This occurs because the fluid will push the ball against the valve opening, and the ball will prevent fluid from flowing.

Figure 2:
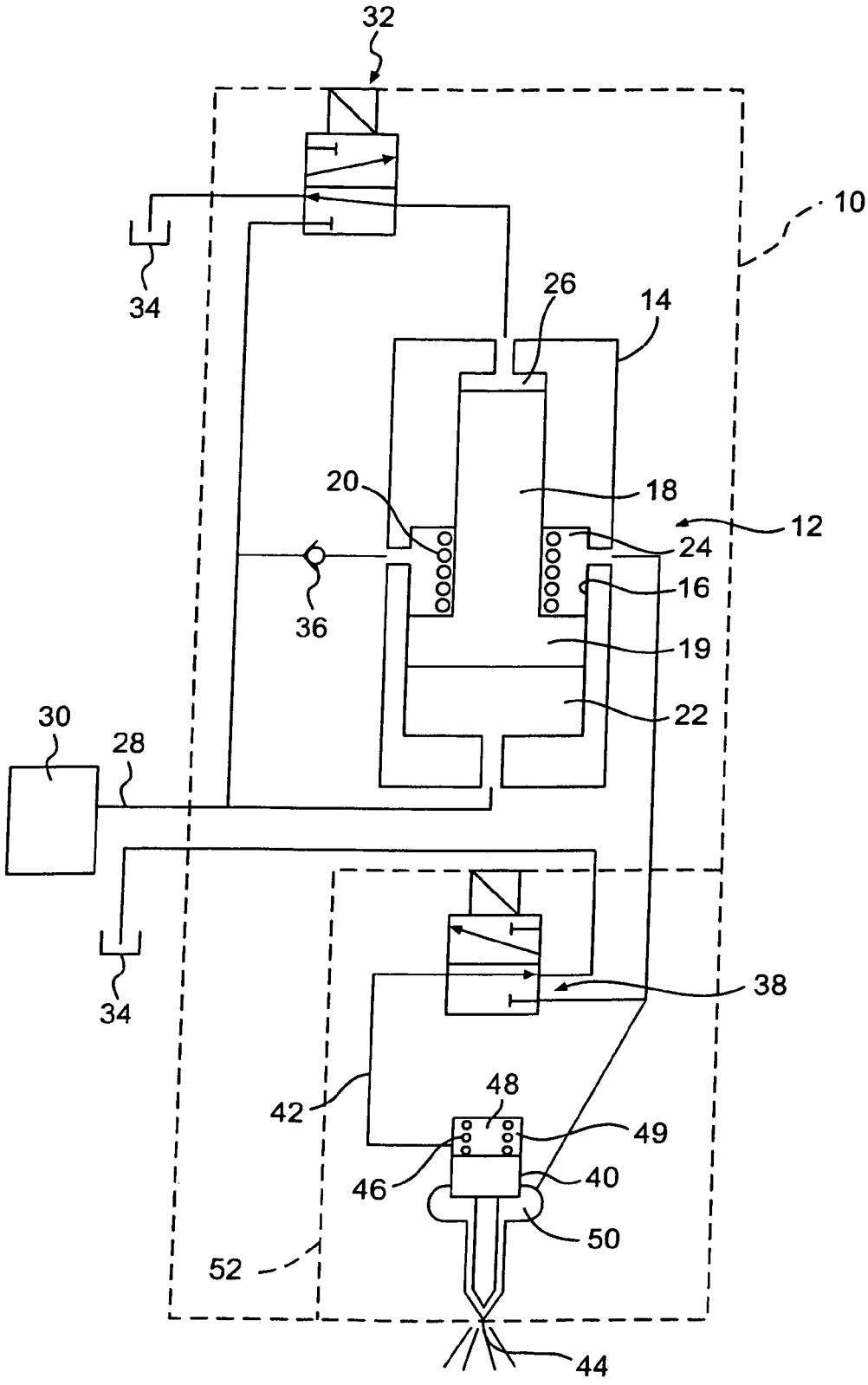
FIG. 2. is a schematic illustration of the fuel injector of FIG. 1 injecting intensified fuel.

Nozzle assembly 52 may include a second control valve 38, a nozzle chamber 48, a nozzle spring 46, and a nozzle check piston 40. Nozzle check piston 40 may be T-shaped or it may take another shape. Nozzle check piston 40 may be deposed in nozzle chamber 48 separating nozzle chamber 48 into a check cavity 49 and a nozzle cavity 50. Second control valve 38 may be directly connected to check cavity 49 through a nozzle check passage 42. Nozzle check piston 40 can move between a first or closed position (FIG. 1) and a second or open position (FIG. 2). In its closed position, nozzle check piston 40 prevents communication between one or more flow orifices 44 and high pressure fuel in nozzle cavity 50. In its open position, nozzle check piston 40 allows communication between high pressure fuel in nozzle cavity 50 and flow orifice 44. High pressure fuel in nozzle check passage 42 and nozzle spring 46 bias nozzle check piston 40 towards its closed position.

Second control valve 38 may be a solenoid actuated control valve. As noted above, typical solenoid actuated control valves control the movement of a valve member from a closed position to an open position using a bias spring and an electromagnetic force created by a solenoid. It should be understood, however, that other types of control valve assemblies, such as piezoelectric valves, may be used with the present disclosure. Energization of second control valve 38 allows communication between nozzle check passage 42 and low pressure drain 34. Furthermore, energization of second control valve 38 prevents communication between pressurization chamber 24 and nozzle check passage 42. De-energization of second control valve 38 allows communication between a pressurization chamber 24 and nozzle check passage 42 (FIG. 1).

A control unit (not shown) for fuel injector 10 controls the activation of first control valve 32 and second control valve 38. Alternatively, more than one control unit may be utilized to control activation of first control valve 32 and second control valve 38.

It should be understood that the present disclosure may utilize end of injection rate shaping as is practiced in the art, in order to reduce unwanted emissions and improve fuel efficiency. For example, the control unit may operate second control valve 38 in a manner to create various fuel injection rate shapes, including square, boot, ramp, or and other similar rate shapes, to match particular operating conditions of the work machine with particular rate shapes to improve fuel efficiency and reduce unwanted emissions.

It should be understood that each of the above described components may be included in a single unit fuel injector 10. Alternatively, fuel injector 10 may include separate components forming the nozzle assembly 52.

Each of the components described above may be fabricated from any rigid material, such as steel, aluminum, or cast iron.

INDUSTRIAL APPLICABILITY

Before injection, first control valve 32 allows communication between fuel line 28 and control chamber 26. Fuel enters pressurization chamber 24 from fuel line 28 after passing through one-way valve 36. Fuel also enters intensification chamber 22 from fuel line 28. Piston spring 20, along with pressure from pressurization chamber 24 and pressure from control chamber 26, act on piston 18, urging piston 18 to a fully open position as seen in FIG. 1.

Referring to FIG. 2, to pressurize fuel in pressurization chamber 24, the control unit activates first control valve 32 to allow fluid communication between control chamber 26 and low pressure drain 34. When activated, first control valve 32 prevents communication between fuel line 28 and control chamber 26. As can be seen in FIG. 2, when first control valve 32 is activated, fuel in control chamber 26 may communicate with low pressure drain 34 and flow out when the pressure in the low pressure drain 34 is less than the pressure of the fuel in control chamber 26. As the fuel in control chamber 26 flows out to low pressure drain 34, fuel in intensifier chamber 22 will urge piston 18 away from its starting position and decrease the size of pressurization chamber 24. This decrease in size of pressurization chamber 24 will pressurize or intensify the fuel in pressurization chamber 24.

To inject the intensified fuel into the combustion chamber (not shown), the control unit activates second control valve 38 to allow communication between nozzle check passage 42 and low pressure drain 34. As the pressure in nozzle check passage 42 decreases, pressure from fuel in nozzle cavity 50 urges nozzle check piston 40 towards its open position as illustrated in FIG. 2 against the force of nozzle spring 46. In its open position, nozzle check piston 40 allows communication between the one or more flow orifices 44 and nozzle cavity 50, allowing fuel to enter the combustion chamber.

To stop injection, the control unit deactivates second control valve 38 allowing communication between nozzle check passage 42 and pressurization chamber 24. Pressure from fuel in check cavity 48 and from nozzle spring 46 urge nozzle check piston 40 towards its closed position, ending injection.

Figure 3:
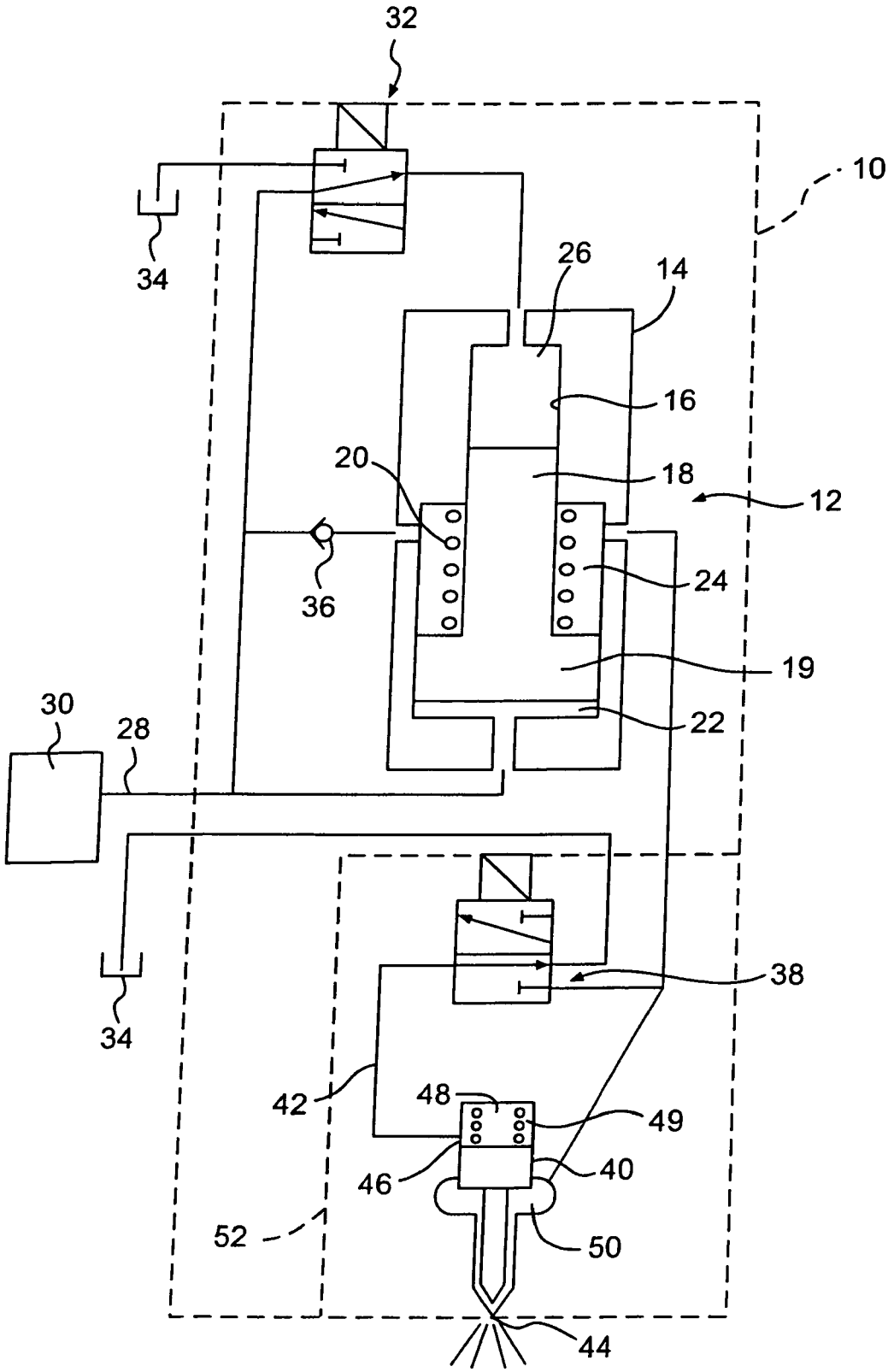
FIG. 3 is a schematic illustration of the fuel injector of FIG. 1 injecting non-intensified fuel.

Alternatively, injection can occur without activating first control valve 32. In this operation, non-intensified fuel can be injected into the combustion chamber. Referring to FIG. 3, high pressure fuel enters pressurization chamber 24 from fuel line 28 after passing through one-way valve 36. Fuel also enters intensifier chamber 22 from fuel line 28. When deactivated, first control valve 32 allows communication between fuel line 28 and control chamber 26. Piston spring 20, along with pressure from pressurization chamber 24 and pressure from control chamber 26, act on piston 18, urging piston 18 towards its starting position, as shown in FIG. 1. To start injection, the control unit activates second control valve 38 to allow communication between nozzle check passage 42 and low pressure drain 34. Pressure from fuel in nozzle cavity 50 urges nozzle check piston 40 towards its open position as the pressure in nozzle check passage 42 decreases. In its open position, nozzle check piston 40 allows fluid communication between flow orifice 44 and nozzle cavity 50, allowing fuel to flow into the combustion chamber as illustrated in FIG. 3. This arrangement allows for fuel from high pressure fuel source 30 to flow through the pressurization chamber 24 of the intensifier assembly 12 and into the combustion chamber without intensifying the fuel. To stop injection, the control unit deactivates second control valve 38 allowing communication between nozzle check passage 42 and pressurization chamber 24. Pressure from fuel in nozzle check passage 42 and nozzle spring 46, urge nozzle check piston 40 towards its closed position, ending injection.

This arrangement of first, second and one-way valves 32, 38, and 36 with the intensifier assembly 12 and utilization of internal chamber 16 allows for non-intensification, without requiring a separate bypass fuel line to connect the high pressure fuel source 30 to the nozzle cavity 50. As described above, high pressure fuel flows from high pressure fuel source 30 to one-way valve 36 through pressurization chamber 24 to nozzle cavity 50. By selectively activating first control valve 32, the control unit for the fuel injector 10 can send intensified or non-intensified fuel to the nozzle check piston 40 for injection into the combustion chamber. This arrangement of components is less complex than bypass arrangements that allow for non-intensified fuel injection. In addition, reducing the number of components and/or fuel passages needed to get both intensified and non-intensified fuel injected into the combustion chamber may reduce the cost.

Between injections, the control unit deactivates first control valve 32, allowing communication between fuel line 28 and control chamber 26. Pressure from fuel in pressurization chamber 24 and pressure from fuel in control chamber 26 along with force from piston spring 30, cause piston 18 to return to its fully open position as illustrated in FIG. 1.

For some applications, selectively controlling the amount of intensifier piston reset may prove advantageous. For example, the control unit can control activation of first control valve 32 to control the amount of piston 18 reset and cause piston 18 to only partially return to its fully open position. To accomplish this, the control unit deactivates first control valve 32 for a certain period of time between injections. The length of deactivation of control valve 32 would correspond to a certain amount of high pressure fuel allowed to communicate with control chamber 26. The fuel in control chamber 26 causes an increase in fuel pressure acting on piston 18. This increase in pressure in control chamber 26 would add to the force from piston spring 20 and pressure from fuel in pressurization chamber 24 to urge piston 18 towards its starting position. The amount of force from the fuel in control chamber 26 would be less than the amount needed to urge the piston to its starting position because only a certain amount of fuel would be allowed to communicate with the control chamber 26. When the first control Valve 32 is activated and fuel from control chamber 26 flows out to low pressure drain 34, the reduction in the size of pressurization chamber 24 will be less than the reduction in the pressurization chamber 24 when the piston 18 is in its starting position. To control the amount of intensification using first control valve 32, the manufacturer of fuel injector 10 can test a nominal fuel injector 10 to determine the amount of intensification for each activation duration of first control valve 32. Based on these tests, the manufacturer can create a map of intensification as a function of first control valve 32 activation duration for use by the control unit. Controlling the amount of intensification would allow the control unit to match a certain amount of intensification with a particular operating condition to improve fuel efficiency and/or reduce unwanted emissions.

It should be understood that alternative flow configurations may be implemented provided a control valve controls activation of the intensifier piston, another control valve directly controls injection, and fuel flows through the intensifier to the nozzle tip. Further, while the present disclosure is described in connection with one fuel injector 10, it is appreciated that the disclosure may be applied to multiple fuel injectors.

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims and their equivalents.

What is claimed is:

1. A fuel injector for use with a pressurized fuel source and at least one drain, the fuel injector comprising:

an intensifier assembly including:

a control chamber co-axially positioned opposite from an intensification chamber, and a pressurization chamber co-axially positioned between the control chamber and the intensification chamber;

a first control valve is associated with the control chamber, the first control valve having a first position in which the control chamber fluidly communicates with the pressurized fuel source, and a second position in which the control chamber fluidly communicates with the at least one drain;

the intensification chamber fluidly communicating with the pressurized fuel source; and the pressurization chamber fluidly communicating with the pressurized fuel source; and a nozzle assembly including:

a nozzle cavity fluidly communicating with the pressurization chamber;

a nozzle chamber; and a second control valve fluidly communicating with pressurization chamber, the nozzle chamber and the at least one drain, the second control valve having a first position in which the nozzle chamber fluidly communicates with the pressurization chamber, and a second position in which the nozzle chamber fluidly communicates with the at least one drain;

wherein the fuel injector delivers intensified fuel from the nozzle cavity when the first control valve is in the second position and the second control valve is in the second position, and wherein the fuel injector delivers non-intensified fuel from the nozzle cavity when the first control valve is in the first position and the second control valve is in the second position.

2. The fuel injector of claim 1, wherein a one-way flow control valve allows fluid communication between the pressurized fuel source and the pressurization chamber.

3. The fuel injector of claim 2, wherein the one-way flow control valve is a ball check valve.

4. The fuel injector of claim 1, wherein the first and second control valves are solenoid actuators.

5. The fuel injector of claim 1, wherein the fuel injector does not deliver fuel from the nozzle cavity when the second control valve is in the first position.

6. A fuel injector comprising:

an intensifier assembly connected to at least one drain and a pressurized fuel source, the intensifier assembly including:

an internal chamber housing an intensifier piston separating the internal chamber into a control chamber, an intensification chamber, and a pressurization chamber, in which the control chamber is co-axially positioned opposite from the intensification chamber, and the pressurization chamber is co-axially positioned between the control chamber and the intensification chamber;

the control chamber selectively fluidly communicating with the pressurized fuel source and the drain;

the intensification chamber fluidly communicating with the pressurized fuel source;

the pressurization chamber fluidly communicating with the pressurized fuel source via a flow control valve;

the flow control valve allowing continuous supply of fluid to the pressurization chamber, and a first control valve associated with the control chamber, the first control valve having a first position, in which the control chamber fluidly communicates with the pressurized fuel source, and a second position, in which the control chamber fluidly communicates with the at least one drain; and a nozzle assembly including:

a nozzle cavity fluidly communicating with the pressurization chamber;

a nozzle chamber; and a second control valve fluidly communicating with pressurization chamber, the nozzle chamber and the at least one drain, the second control valve having a first position in which the nozzle chamber fluidly communicates with the pressurization chamber, and a second position in which the nozzle chamber fluidly communicates with the at least one drain;

wherein the fuel injector delivers intensified fuel from the nozzle cavity when the first control valve is in the second position and the second control valve is in the second position, and wherein the fuel injector delivers non-intensified fuel from the nozzle cavity when the first control valve is in the first position and the second control valve is in the second position.

7. The fuel injector of claim 6, wherein a flow control valve allows fluid communication between the pressurized fuel source and the pressurization chamber.

8. The fuel injector of claim 7, wherein the flow control valve is passively operated.

9. The fuel injector of claim 8, wherein the flow control valve is a ball check valve.

10. The fuel injector of claim 6, wherein the first and second control valves are solenoid actuators.

11. The fuel injector of claim 6, wherein the fuel injector does not deliver fuel from the nozzle cavity when the second control valve is in the first position.

12. A method for selectively intensifying fuel for injection utilizing a fuel injector, comprising:

providing a control chamber co-axially positioned opposite from an intensification chamber, and a pressurization chamber co-axially positioned between the control chamber and the intensification chamber;

fluidly communicating the intensification chamber with a pressurized fuel source;

selectively fluidly communicating the control chamber with the pressurized fuel source and at least one drain, wherein a first control valve is associated with the control chamber, the first control valve having a first position in which the control chamber fluidly communicates with the pressurized fuel source, and a second position in which the control chamber fluidly communicates with the at least one drain;

fluidly communicating the pressurization chamber with the pressurized fuel source;

pressurizing fuel in the pressurization chamber by selectively connecting the control chamber to the at least one drain;

fluidly communicating a nozzle cavity of a nozzle assembly with the pressurization chamber;

controlling injection by selectively connecting a nozzle chamber of the nozzle assembly to the at least one drain, wherein the nozzle assembly includes a second control valve, the second control valve having a first position in which the nozzle chamber fluidly communicates with the pressurization chamber, and a second position, in which the nozzle chamber fluidly communicates with the at least one drain;

causing the fuel injector to deliver intensified fuel from the nozzle cavity when the first control valve is in the second position and the second control valve is in the second position; and causing the fuel injector to deliver non-intensified fuel from the nozzle cavity when the first control valve is in the first position and the second control valve is in the first position.

13. The method of claim 12, wherein a one-way flow control valve allows fluid communication between the pressurized fuel source and the pressurization chamber.

14. The method of claim 13, wherein the one-way flow control valve is a bal check valve.

15. The method of claim 12, further comprising preventing the fuel injector from delivering fuel from the nozzle cavity when the second control valve is in the first position.

* * * * *

UNITED STATES PATENT AND TRADEMARK OFFICE

CERTIFICATE OF CORRECTION

PATENT NO. : 8,100,110 B2
APPLICATION NO. : 11/642743
DATED : January 24, 2012
INVENTOR(S) : Shinogle et al.

It is certified that error appears in the above-identified patent and that said Letters Patent is hereby corrected as shown below:

In the Specification

Column 2, line 44, delete “assembly” and insert -- assembly. --.

Column 2, line 63, delete “FIG. 1.” and insert -- FIG. 1 --.

Column 2, line 66, delete “FIG. 2.” and insert -- FIG. 2 --.

Column 3, line 67, delete “may be operate” and insert -- may be operated --.

Column 4, line 49, delete “or and” and insert -- and/or --.

Column 6, line 34, delete “Valve 32” and insert -- valve 32 --.

In the Claims

Column 10, line 2, in Claim 14, delete “bal” and insert -- ball --.

Signed and Sealed this
Eleventh Day of August, 2015

Michelle K. Lee

Michelle K. Lee
*Director of the United States Patent and Trademark Office*